US009387482B2

(12) United States Patent
Goodrich et al.

(10) Patent No.: US 9,387,482 B2
(45) Date of Patent: Jul. 12, 2016

(54) SLUICE BOX AND METHOD OF USE

(76) Inventors: Bob Goodrich, Kaysville, UT (US); Shari Goodrich, Kaysville, UT (US)

( * ) Notice: Subject to any disclaimer, the term of this patent is extended or adjusted under 35 U.S.C. 154(b) by 772 days.

(21) Appl. No.: 12/691,439

(22) Filed: Jan. 21, 2010

(65) Prior Publication Data

US 2010/0236993 A1 Sep. 23, 2010

Related U.S. Application Data

(60) Provisional application No. 61/160,747, filed on Mar. 17, 2009.

(51) Int. Cl.
*B07B 9/00* (2006.01)
*B03B 5/26* (2006.01)

(52) U.S. Cl.
CPC ..... *B03B 5/26* (2013.01)

(58) Field of Classification Search
CPC ..... B03B 5/02; B03B 5/26; B03B 5/72; B03B 7/00
USPC ..... 209/44, 311, 313, 314, 420
See application file for complete search history.

(56) References Cited

U.S. PATENT DOCUMENTS

| | | | | |
|---|---|---|---|---|
| 1,973,770 | A * | 9/1934 | McCullough | 209/14 |
| 4,519,896 | A * | 5/1985 | Vickery | 209/44.1 |
| 4,525,270 | A * | 6/1985 | McCann | 209/44 |
| 5,421,461 | A * | 6/1995 | Ruzic | 209/44 |
| 6,216,367 | B1 * | 4/2001 | Tubbs | 37/314 |
| 6,799,681 | B1 * | 10/2004 | Warren | 209/44 |
| 7,093,719 | B2 * | 8/2006 | Roper | 209/420 |
| 2003/0127376 | A1 * | 7/2003 | Maddock et al. | 210/114 |
| 2009/0078615 | A1 * | 3/2009 | Rainwater et al. | 209/44 |

* cited by examiner

*Primary Examiner* — Joseph C Rodriguez
*Assistant Examiner* — Kalyanavenkateshware Kumar
(74) *Attorney, Agent, or Firm* — J. Todd Rushton

(57) ABSTRACT

A portable sluice box for efficient processing and classification of alluvial sand, gravel, detritus, or classification of rock that has been mined and crushed. Sluice having three stages of material classification including, a movable primary screen, viewable secondary screen, distributor box with flow control baffle, laminar flow stratification trough, and cleanable bottom riffle system.

6 Claims, 3 Drawing Sheets

SLUICE BOX AND METHOD OF USE

SUMMARY OF THE INVENTION

Application claims priority to provisional application 61/160,747, filed Mar. 17, 2009, under 35 USC 119(e).

The present invention relates generally to a sluice box and more specifically to a portable sluice box having three stages of material classification, a dumping primary screen, viewable secondary screen, distributor box with flow control baffle, and cleanable riffle system.

The sluice box allows for efficient processing and classification of alluvial sand, gravel and detritus or classification of rock that has been mined and crushed. Waste rock and material is processed through the sluice box, while desired minerals, gems and mineralized rock is collected by the device at primary and secondary screens or at a tertiary bottom riffle system. The sluice box is designed to allow maximum portability without sacrificing material classification ability. The device can readily be transported to a stream, lake or another water source and set up for processing directly on, the ground, a stream bank having a moderate slope, rocks in the stream, a stand or on a table. Process material may be available at the water source or material may be transported from another remote location for processing.

In one embodiment, the sluice box includes, a top hopper, primary screen, secondary screen, primary collection trough, distributor box with metering baffle, secondary collection trough, and bottom riffle system.

The hinged top hopper includes, a header board and side boards with a primary or grizzly screen deck. The primary screen deck composed of plated standard ½ inch expanded steel. The back lip of the top hopper is open. The hopper allows material to be introduced on the primary screen deck for processing. The material is washed using a bucket or hose until the water runs clear at the outflow of the system and all material less than ½ inch is washed through the primary screen onto a secondary screen deck. Material remaining on the primary screen may now be sorted for large gem stones, mineralized rocks or gold nuggets. The primary screen deck may now be tilted back, dumping the waste rock out of the top hopper and allowing an unobstructed view of the secondary screen.

The secondary screen is composed of ¼ inch flat expanded steel and restricts passage of all material greater than ¼ inch in size. The remaining gravel on the secondary screen, ½ inch minus to ¼ inch plus, may then be searched for desired gems, rocks and nuggets. Material on the secondary screen is constrained by a back board and side boards; the bottom edge of the rectangular screen is open, allowing waste material to be cleared by hand, or by using a board, trowel or may be washed using a rinse bucket or water hose. All material less than ¼ inch and a portion of the wash water will pass through the secondary screen into a primary collection trough.

The wash water and fine material flows over the bottom lip of the primary collection trough and discharges against the back wall of a metered distributor box. A baffle plate extends downward from the bottom lip of the primary collection trough towards the bottom of the secondary collection trough, the interruption of flow caused by the back wall of the distributor box and the restriction of the baffle, creates a turbulent recirculating wash inside of the distributor box, further breaking down cemented rock particles. Flow between the primary collection trough and the secondary collection trough is regulated by the baffle plate. In one embodiment, the baffle plate creates a fixed orifice. In another embodiment, the baffle plate is adjustable, allowing the user to fine tune the amount of water and material flowing into the secondary trough. When water is introduced into the system at the top hopper and is collected in the primary trough, only the portion metered by the baffle will pass into the secondary trough, any excess water will spill over the back wall of the distributor box. A gap between the lip of the trough and the back wall ensures that only water and none of the heavy classified material will discharge over the back wall.

Water and material that flows into the distributor box and under the baffle plate enters a smooth secondary trough section of the bottom pan. This section allows for laminar water flow and stratification of the remaining fine material particles. Water at the top of the column will run essentially clear, wood and organics will be found at a secondary level, non-metal sand is suspended in a third strata, the bottom level will include the desired metal particles, small gems and small metal nuggets.

After stratification, the water and material is introduced into a riffle system consisting of, a ridged resilient material mat, held in place by a plated ½ standard expanded steel hinged cover. When the water and stratified material courses over the riffle system, the laminar water flow is interrupted and the metal particles, small gems and small metal nuggets are deposited in low velocity areas directly behind the leading edge of the expanded steel gaps and on the material mat. All light weight waste material is washed over the riffle system and out of the sluice box. It is desirable to periodically inspect the riffle system and remove any visible gems or nuggets. If the expanded metal gaps and the material mat are overloaded with heavy material or if the user is finished processing material, the expanded metal can be released and lifted off the material mat. The material mat can now be removed and the heavy material, including small gems and gold particles can be rinsed into a gold pan or onto a vibratory table for final classification.

One embodiment may include a handle or strap for easy transportation. Another embodiment may include removable backpack straps, allowing a user to portage the sluice into remote areas and over long distances. Another embodiment may include mechanical attachments allowing the user to carry all necessary prospecting tools including, a shovel, rock hammer, snuffer bottle, gold pan, collapsible miner's bucket, lunch and supplies.

DETAILED DESCRIPTION OF THE INVENTION

In one embodiment, portable sluice box 100 is a material separation system using three stages of classification as shown in FIGS. 1 through 3B. Sluice box 100 includes, primary screen 110, secondary screen 120 and a tertiary riffle system 130.

Figure 3A:
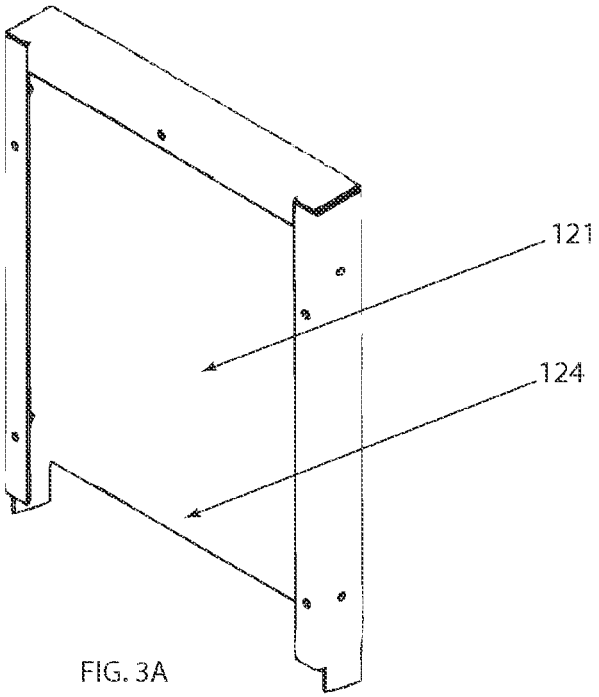
FIG. 3A—Primary trough.
Figure 3B:
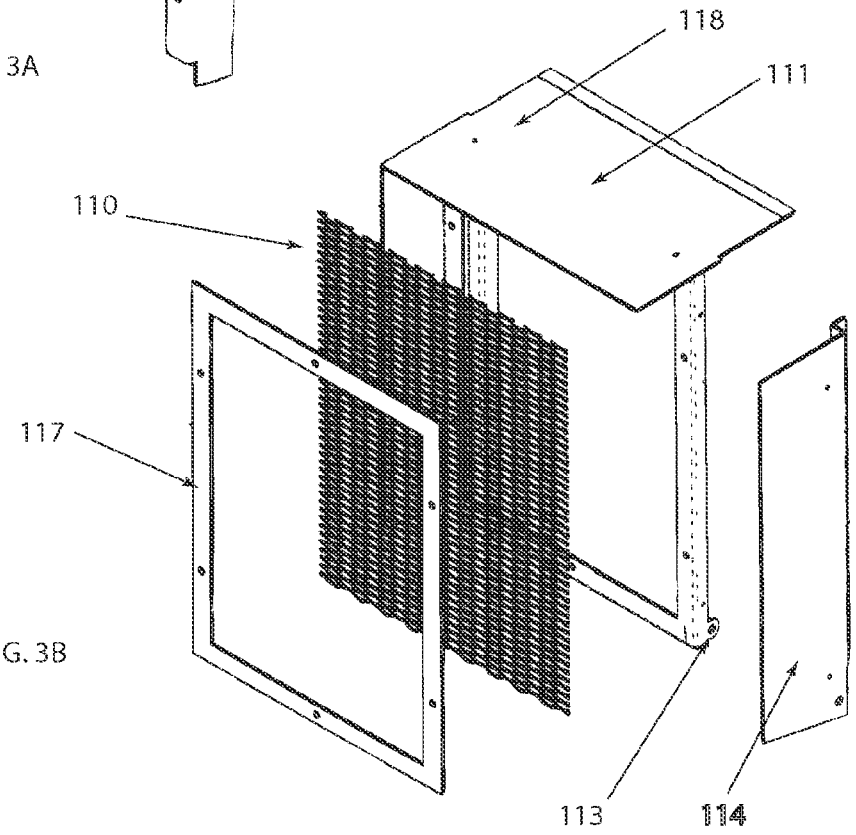
FIG. 3B—Top box and primary screen assembly.

The primary screen 110, FIG. 3B, includes a standard ½ inch expanded steel screen mounted by frame 117 in the bottom of top hopper 111. Material is constrained on primary screen 110 by back wall 118 and side walls 114 and 115 of the top hopper. Once material has been classified on the primary screen 110, waste material can be removed by simply tilting the top hopper 111 back on hinge point 113 and discharging the waste material behind sluice 110. When top hopper 111 is tilted back, secondary screen 120 is clearly visible.

Figure 1A:
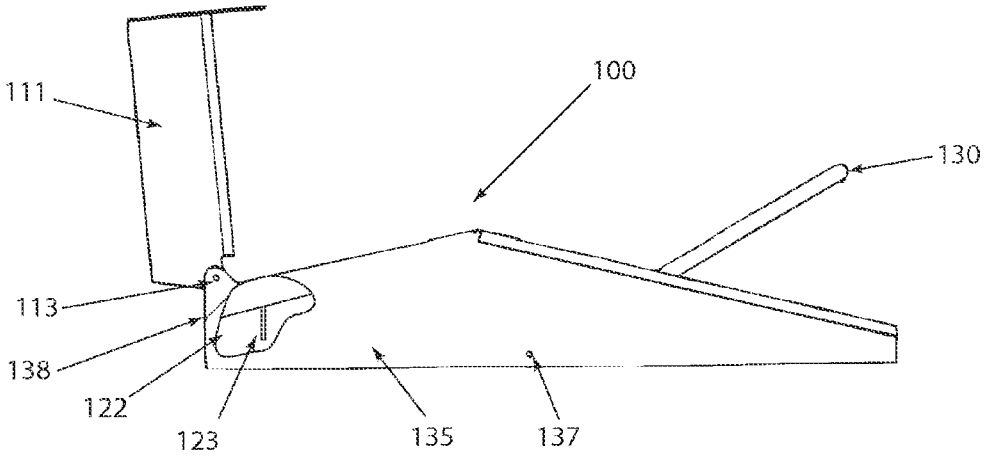
FIG 1A—Side view of the sluice box.
Figure 1B:
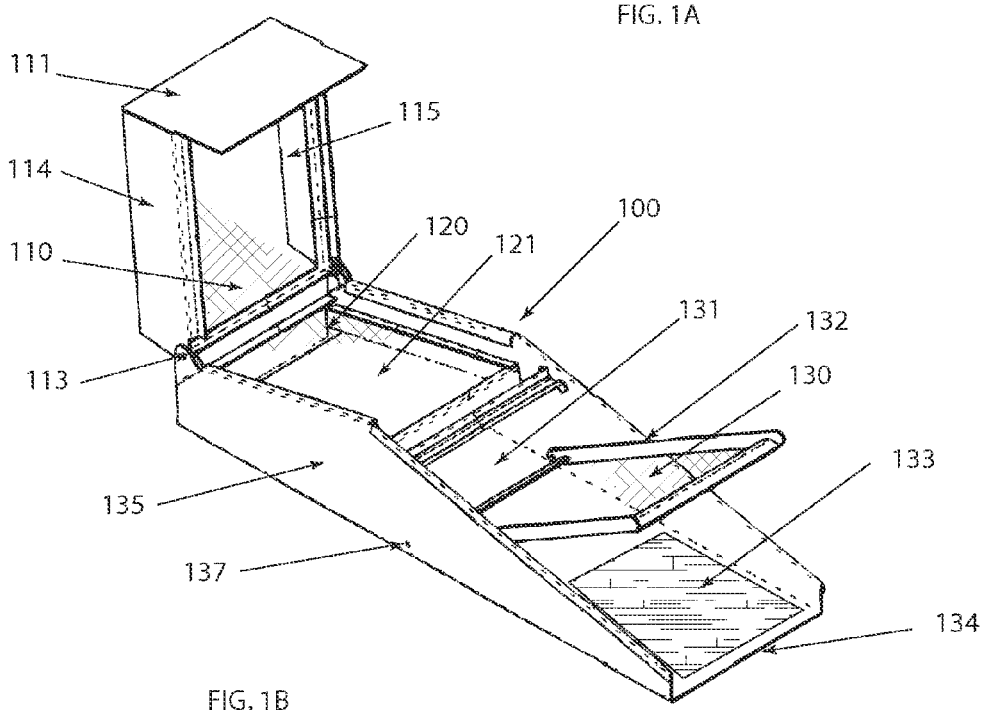
FIG. 1B—Orthogonal view of the sluice box.
Figure 2:
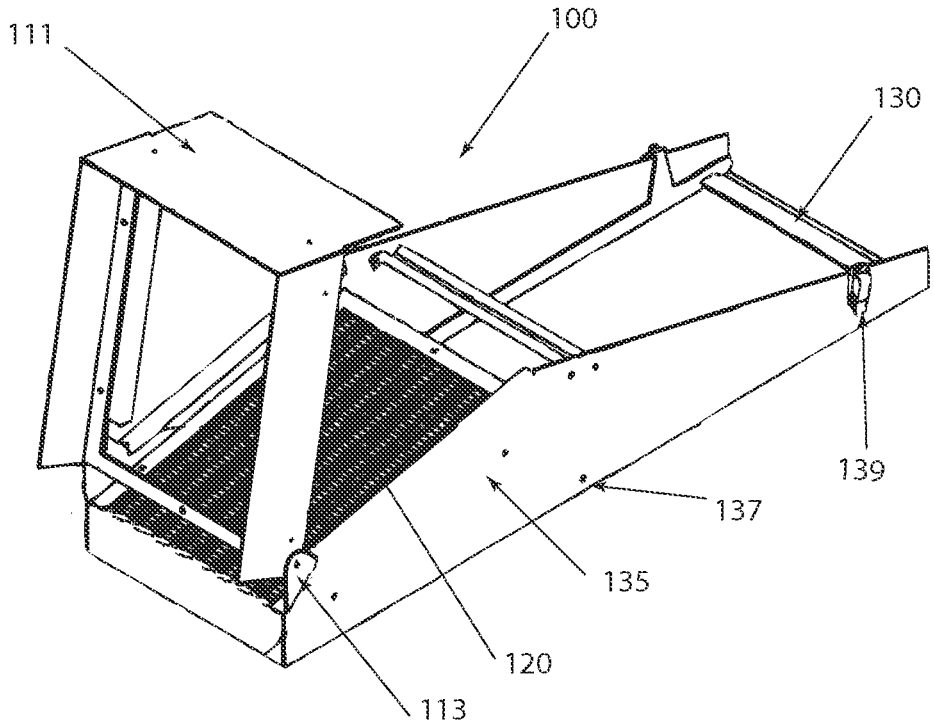
FIG. 2—Orthogonal view of the sluice box including a secondary screen deck.

After passing through the primary screen 110, the classified material is discharged onto the secondary screen 120, FIGS. 1B and 2. The secondary screen 120 is composed of flat ¼ expanded steel and is fixedly attached over the primary trough 121, FIGS. 1B and 3A. Material that is washed onto the primary trough 121 is discharged over lip 124 and against the back wall 138 of a distributor box 122, FIGS. 1A and 1B. The distributor 122 is formed by back wall 138, secondary trough bottom 131, side walls 135 and a baffle plate 132. In one embodiment, baffle plate 132 may be fixed, in a second embodiment, baffle plate 132 may be adjustable. Flow into the distributor box 122 creates a recirculating turbulent zone within the box 122, distributing material across the width of the box 122 and further breaking down cemented material particles. Excess water within the system is discharged over the back wall 138 of the distributor box 122. A metered portion of the material and water flows under baffle plate 132 and into the secondary trough 131.

Flow in the secondary trough 131 is essentially laminar, allowing material in the water column to stratify prior to final classification within the bottom riffle system 130. The bottom riffle system 130 includes a resilient material mat 133, held in place by ½ inch expanded steel classifying cover 132. The cover is hinged 137 allowing the user to release locking mechanism 139, FIG. 2, lift the classifying cover 132 and remove or clear the underlying resilient mat 133 of small gems or metal particles. Waste material and the remaining process water exits the system at discharge lip 134.

The invention claimed is:

1. A portable sluice box comprising;

a top hopper having a primary screen, a secondary screen directly below the primary screen, the top hopper hinged to dump classified material from the primary screen and to facilitate removal of classified material from the secondary screen, a classified material distributor box having a flow control baffle, a laminar flow stratification trough, the laminar stratification trough having a smooth bottom surface, a tertiary classification riffle system, the classified material distributor box directly under the secondary screen and configured to receive all of the classified material passing through the secondary screen, the flow control baffle forming a single orifice that restricts discharge of the classified material from the material distributor box to the laminar flow stratification trough, the classified material discharging from the laminar flow stratification trough to the tertiary riffle system, and, the portable sluice box sized to be transported by hand.

2. The portable sluice box of claim 1, wherein the orifice formed by the flow control baffle is fixed.

3. The portable sluice box of claim 1, wherein the orifice formed by the flow control baffle is adjustable.

4. The portable sluice box of claim 1, wherein the tertiary classification system includes a hinged classification cover.

5. The portable sluice box of claim 1, wherein the tertiary classification system includes a removable resilient fine material collection mat.

6. A method of classification using a portable sluice box comprising:

providing a portable sluice box that is transportable by hand;

loading material into a dumpable top hopper having a primary screen positioned directly over a secondary screen;

washing material to classify a portion of the material through the primary screen;

inspecting remaining material on the primary screen;

remove desired material from the primary screen;

lift top hopper to dump waste material off of primary screen and allow access to the secondary screen;

inspect classified material on the secondary screen;

remove desired material from the secondary screen;

inspect classified material on a tertiary riffle system having a releasable top cover and a fine material collection mat;

only classified material passing through the secondary screen is processed through the tertiary classification riffle system;

remove identifiable desired classified material from the tertiary riffle system;

unlock releasable top cover;

lift releasable top cover;

remove fine material collection mat;

clear fine material collection mat into final classification device;

replace fine material collection mat;

close top cover;

lock top cover and;

replace primary screen.

* * * * *